US005714656A

United States Patent [19]

Ciali et al.

[11] Patent Number: 5,714,656

[45] Date of Patent: Feb. 3, 1998

[54] BASES FOR LUBRICATING OILS AND PROCESS FOR THEIR PREPARATION

[75] Inventors: Massimo Ciali; Rosanna Ontano, both of Milan; Pierino Radici, Turate; Armando Marcotullio, S. Donato Mil.SE; Paolo D'Antona, Assago, all of Italy

[73] Assignee: Condea Augusta S.P.A., Milan, Italy

[21] Appl. No.: 744,214

[22] Filed: Nov. 5, 1996

[30] Foreign Application Priority Data

Nov. 30, 1995 [IT] Italy ..... MI95A2501

[51] Int. Cl.[6] ..... C10M 101/00; C10M 105/04

[52] U.S. Cl. ..... 585/10; 585/10; 585/12; 585/13; 208/19

[58] Field of Search ..... 208/19; 585/10, 585/12, 13

[56] References Cited

U.S. PATENT DOCUMENTS

| | | | |
|---|---|---|---|
| 3,926,579 | 12/1975 | Rossi et al. | 585/13 |
| 3,965,018 | 6/1976 | Heilman et al. | 208/19 |
| 4,132,663 | 1/1979 | Heilman et al. | 44/459 |
| 4,218,330 | 8/1980 | Shubkin | 585/13 |
| 4,876,017 | 10/1989 | Trahan et al. | 252/8.51 |
| 5,146,021 | 9/1992 | Jackson et al. | 585/12 |
| 5,146,022 | 9/1992 | Buchanan et al. | 585/12 |
| 5,171,909 | 12/1992 | Sanderson et al. | 585/12 |
| 5,364,994 | 11/1994 | Scharf | 585/13 |
| 5,593,463 | 1/1997 | Gambini et al. | 585/10 |
| 5,602,086 | 2/1997 | Le et al. | 585/10 |

*Primary Examiner*—Margaret Medley

*Attorney, Agent, or Firm*—Oblon, Spivak, McClelland, Maier & Neustadt, P.C.

[57] ABSTRACT

Composition of lubricating oil which comprises: a) a greater portion of synthetic lubricating component or a mixture of synthetic lubricating component and a mineral base for lubricating oils, the synthetic lubricating component being prepared by the oligomerization and subsequent hydrogenation and the possible removal of low-boiling by-products, of a composition of olefins basically consisting of:

1) a mixture of n-olefins having a content of olefins from $C_{14}$ to $C_{17}$, preferably from $C_{15}$ to $C_{16}$, of at least 80%, preferably greater than 85%, 2) alpha olefins from $C_{15}$ to $C_{17}$, preferably basically $C_{16}$, the content of the alpha olefin (2) being from 5 to 25% by weight, preferably from 10 to 20%, with respect to the sum of (1)+(2).

12 Claims, No Drawings

BASES FOR LUBRICATING OILS AND PROCESS FOR THEIR PREPARATION

The present invention relates to bases for lubricating oils and the process for their preparation.

The possibility of obtaining bases for lubricating oils by the oligomerization and subsequent hydrogenation of internal olefins is described in literature.

In particular IT-A-20106 A/80 describes the oligomerization of internal olefins, particularly internal olefins having a number of carbon atoms of between 12 and 20, preferably between 15 and 18.

The above oligomerization takes place in the presence of suitable catalysts, particularly adducts of $AlCl_3$ with esters, complexes of $BF_3$ with alcohols, organic and inorganic acids. As shown from mass spectrometry and bromometric titrations, the oligomers thus obtained generally have a double bond for each molecule. The oligomerization usually produces a mixture of dimers and trimers, the higher oligomers generally being less than 5–10%. The unsaturated oligomers are then hydrogenated in the presence of catalysts well known to experts in the field.

The products thus obtained, without any possible light products, are called PIO (poly internal olefins).

The main use of the above PIO, particularly those deriving from compositions mainly consisting of C15-C16 n-olefins, is as a base for synthetic or semi-synthetic lubricating oils.

A composition has now been found which, with the same viscosity at a high temperature, improves the already good viscosity characteristics at room temperature of the above PIO.

In accordance with this, the present invention relates to a composition of lubricating oil which comprises:

a) a greater portion of synthetic lubricating component or a mixture of synthetic lubricating component and a mineral base for lubricating oils, the synthetic lubricating component being prepared by the oligomerization and subsequent hydrogenation and the possible removal of low-boiling by-products, of a composition of olefins basically consisting of:

1) a mixture of n-olefins having a content of olefins from $C_{14}$ to $C_{17}$, preferably from $C_{15}$ to $C_{16}$, of at least 80%, preferably greater than 85%, 2) alpha olefins from $C_{15}$ to $C_{17}$, preferably basically $C_{16}$, the content of the alpha olefin (2) being from 5 to 25% by weight, preferably from 10 to 20%, with respect to the sum of (1)+(2).

The term n-olefins means olefins in which the double bond is not solely present in position 1,2 (like alpha-olefins), but on the other hand is statistically distributed along the whole chain.

These n-olefins are preferably obtained with the process called PACOL-OLEX by the dehydrogenation of n-paraffins.

The composition of n-olefins (1) usually contains impurities mainly consisting of paraffins, aromatics and isoparaffins, in a quantity however which is generally less than 10%, usually less than 8%.

The mixture of n-olefins (1) and alpha-olefins (2) will hereinafter be called olefins, for the sake of clarity.

As far as the oligomerization reaction is concerned, this can be carried out (see IT-A-20106 A/80) in the presence of adducts of $AlCl_3$ with esters or complexes of $BF_3$ with alcohols, organic and inorganic acids, dispersions of $AlCl_3$ on supports consisting of silica or alumina. It is preferably however to use complexes of $BF_3$ with inorganic acids, preferably selected from sulphuric acid, phosphorous acid, phosphoric acid. In a preferred embodiment the weight ratio $BF_3$/olefins is from 1.2 to 2.2, preferably from 1.4 to 1.7, grams of $BF_3$ per 100 grams of olefins; the ratio between inorganic acid and olefins is from 0.2 to 0.6, preferably from 0.3 to 0.5, grams of acid per 100 grams of olefins.

The oligomerization reaction is carried out at a temperature of between 0° C. and 180° C., preferably between 20° C. and 90° C., even more preferably between 50° and 70° C.

At the end of the oligomerization reaction it is preferable to neutralize the reaction raw product.

The reaction products consist of oligomers of the starting olefins, mainly dimers and trimers with small quantities of tetramers and pentamers, as shown by gaschromatographic analysis together with mass sepctrometry.

With respect to the hydrogenation step, this can be carried out in the presence of suitable catalysts and under the usual conditions (in particular of pressure and temperature) for the hydrogenation of olefins.

The hydrogenation reaction is preferably carried out in the presence of catalysts based on Pd or Ni, as such or supported, at a temperature of between 150° and 240° C. and a hydrogen pressure of between 10 and 40 kg/cm$^2$.

According to the oligomerization process described above, a conversion degree of the starting olefins of between 70 and 90% is usually obtained, making it necessary to have a step for eliminating the light fractions, normally by distillation.

This step can be carried out at the end of the oligomerization reaction or after the subsequent hydrogenation reaction, preferably after the hydrogenation step.

The bases for lubricating oils thus prepared can be used as a main component for synthetic lubricants or mixed with conventional mineral bases, together, obviously, with smaller quantities of additives.

The conventional mineral bases, which can be possibly used with the oligomerization and hydrogenation product of the present invention, can be of the paraffinic, naphthenic, or mixed paraffin-naphthenic type. In addition they can be distillates or distillation residues, or synthesis products.

In the case of the formulation of lubricants for engines, hydrocarbon fractions basically consisting of distillates of the paraffinic type are preferable.

Typical synthetic lubricating bases which can possibly be mixed with the composition of products of the present invention are esters of monocarboxylic aliphatic acids with polyhydroxylic alcohols, such as trimethylol propane and pentaerythrol; esters of diacids with monofunctional alcohols; synthetic hydrocarbons; polyglycols; thiols; siliconic fluids; polyphenyl ethers; thioethers.

As is known to experts in the field, compositions of lubricating oil contain additives suitable for improving the performance of the synthetic component of the present invention or of the mixture of the above synthetic component with other conventional mineral or synthetic bases.

The additives can therefore be the usual pour point depressants; viscosity index improvers; detergents-dispersants; corrosion, oxidation and wear inhibitors; anti-foaming agents, friction modifiers, etc.

The selection of additives to be included in the finished oil and relative quantities depend on the use and performances desired.

As an example, viscosity index improvers and pour point depressants are contained in the finished oil in a quantity of between 0.01 and 15% by weight; detergents-dispersants (typical examples of which are succinimides) in a quantity of between 0.1 and 15% by weight; corrosion, oxidation and wear inhibitors in a quantity of between 0.01 and 3% by weight; antifoaming agents between 10 and 1000 ppm.

Many other additives with different functions can be used in preparing the final formulates. Many of these components are listed in U.S. Pat. No. 3,864,270, U.S. Pat. No. 4,169,799, U.S. Pat. No. 4,194,981 and U.S. Pat No. 4,253,980.

The following examples provide a better understanding of the present invention.

EXAMPLES

1—Composition of n-Olefins

The substrate subjected to oligomerization and hydrogenation consists of: (1) a mixture of C15-C16 n-olefins; (2) C16 α-olefin.

The mixture of C15-C16 n-olefins has the following composition (Gaschromatographic analysis on a capillary column):

n-Paraffins: 4.04% by weight (of which C15=2.81%, C16=1.07%, C17=0.16%);

n-Olefins: 92.68% by weight (of which C15=70.68%, C16=19.55%, C17=2.45%);

Aromatics+isoparaffins: 3.28%.

The C16 alpha-olefin is a product having a content of alpha-olefins of 94%. Of these alpha-olefins, the content of C16 alpha-olefin is 88%, the remaining 12% consisting of C14 and C18 alpha-olefins.

1—Synthesis of the Bases

The synthesis basically consists of an oligomerization step of the olefins, followed by neutralization and washing of the $BF_3$.acid complex, a hydrogenation step of the oligomers thus obtained and then a stripping step of the light products.

For the oligomerization a 1 liter Brignole autoclave in AISI 316 is used, equipped with a magnetic stirrer, 4 valves of which one is a plunged pipe, a thermometric hole, a thermocouple and digital indicator for measuring the temperature, a manometer able to measure up to 12 kg/cm$^2$.

For the hydrogenation of the oligomers a 1-liter Engeneering autoclave in Hastelloy C is used, equipped with a magnetic stirrer, 4 valves, thermometric hole, thermocouple, digital indicator for measuring the temperature, burst disk calibrated at 30 bars and manometer able to measure up to 25 kg/cm$^2$.

For the stripping, or the distillation of the light products formed during the reaction and non-oligomerized products, a 1-inch adiabatic column (of the Oldershaw type) with 5 plates is used. The operation is carried out at reduced pressure (about 0.5–1 torr) and with a final temperature at the head of about 170°–180° C. until the head products have been completely removed, verified by gaschromatographic analysis on both the head products and residual tail products in the boiler.

The oligomerization of the olefins is carried out by charging the mixture of olefins and inorganic acid into the autoclave with the ceiling open. All the tests, including the comparative ones, were carried out with an almost constant ratio $BF_3$/olefins (from 1.43 to 1.65 grams of $BF_3$ per 100 grams of olefinic composition) and with a constant ratio acid/olefins (0.40 grams of acid per 100 grams of olefins).

A seal test is carried out with nitrogen and the autoclave is flushed four times at 5 kg/cm$^2$, again with nitrogen.

The nitrogen is then degassed and $BF_3$ is fed from a previously weighed cylinder. The stirring is activated (760 rpm) and the temperature is brought to 60° C. After the preset reaction time the $BF_3$ is degassed and sent to appropriate collection traps of $NaOH+Ca(OH)_2$; flushing is repeatedly carried out with nitrogen and the contents of the autoclave is discharged.

The oligomers are neutralized with an aqueous solution of sodium carbonate with the pH value under control and subsequently washed with distilled water.

The olefinic oligomers thus prepared are hydrogenated at 20–25 kg/cm$^2$ of pressure with temperatures of 170°–180° C. using Pd/C at 10% of Pd as catalyst. The reaction is carried out at 1500 rpm of stirring for 7–8 hours until the complete reduction of the starting oligomers. The catalyst is charged in a ratio of 4% with respect to the charge to be hydrogenated.

The oligomers thus hydrogenated are filtered from the catalyst and distilled.

Gaschromatographic analyses are carried out on the weighed distillate and boiler residue and the residue is rheologically characterized.

3—Rheological Characterization

The rheological characterization of the bases is carried out at temperatures of 40° and 100° C. using a series of capillaries of the Cannon Fenske type and a thermostatic bath with a control to a hundredth of degree centigrade.

For the Pour Point and viscosity at −30° C. measurements a rotational rheometer is used with a strain rate range applied is 0.1–1000 sec$^{-1}$ and the relative viscosity value indicated refers to the value of the flow curve at 100 sec$^{-1}$. For the Pour Point measurements a frequency of 1 Hz is used together with an amplitude of 0.001 mrad and a temperature increase of 1° C./min.

The results of the tests and analyses are shown in table 1. Examples 3C/95 and 5C/95 are comparative examples as they are carried out with 30% and 0% of alpha-olefin respectively.

TABLE 1

| | | | Rheological characterization | | | | |
|---|---|---|---|---|---|---|---|
| Test | % αC16 | Yield | 100° C. (cSt) | 40° C. (cSt) | −30° C. (cP) | I.V. | P.P. (°C.) |
| 1/95 | 10 | 87.0 | 5.75 | 29.59 | 2150 | 140 | −35 |
| 4/95 | 15 | 85.6 | 5.87 | 30.74 | 2300 | 138 | −33 |
| 2/95 | 20 | 86.1 | 5.75 | 29.64 | 2200 | 139 | −32 |
| 3C/95 | 30 | 88.0 | 5.86 | 30.51 | 2550 | 139 | −26 |
| 5C/95 | 0 | 83.0 | 5.69 | 30.59 | 2760 | 124 | −45 |

The results of table 1 clearly show the advantages, in terms of viscosity at −30° C., which can be obtained with the compositions containing from 10 to 20% of C16 alpha-olefin. In fact the viscosity values at 100° C. are comparable, whereas the viscosities at −30° C. are improved.

We claim:

1. A lubricating oil composition, consisting essentially of an oligomer synthetic lubricating oil base, which is prepared by oligomerizing and subsequentially hydrogenating an olefin mixture, comprising:

1) a mixture of n-olefins having a content of olefins from C15 to C16 of at least 80%, and 2) C16 α-olefins, wherein the content of said αolefins (2) are from 10 to 20% by weight with respect to the sum of(1) and (2) and further wherein said lubricating oil composition has a viscosity at 30° C. of not more than 2300 cP.

2. The lubricating oil composition of claim 1, wherein the mixture of n-olefins has a content of at least 85%.

3. The lubricating oil composition of claim 1, which further comprises a mineral base.

4. The lubricating oil composition of claim 3, wherein said mineral base is selected from the group consisting of paraffinic, naphthenic and mixed paraffinic-naphthenic mineral bases.

5. The lubricating oil composition of claim 1, which further comprises an additive selected from the group consisting of pour point depressants, viscosity index improvers, detergent-dispersants, corrosion inhibitors, oxidation inhibitors, wear inhibitors, antifoaming agents and friction modifiers.

6. The lubricating oil composition of claim 1, wherein the preparation of said synthetic lubricating component further comprises removing low-boiling by-products.

7. The lubricating oil composition of claim 1, wherein the oligomerization is carded out at between about 0° C. and 180° C.

8. The lubricating oil composition of claim 7, wherein the oligomerization is carried out at between about 20° C. and 90° C.

9. The lubricating oil composition of claim 1, wherein the oligomerization is effected in the presence of adducts of $AlCl_3$ with esters, complexes of $BF_3$ with alcohols, organic or inorganic acids, or dispersions of $AlCl_3$ as supports of silica or alumina.

10. The lubricating oil composition of claim 9, wherein the oligomerization is effected in the presence of $BF_3$ and an inorganic acid selected from the group consisting of sulfuric acid, phosphorous acid and phosphoric acid.

11. The lubricating oil composition of claim 1, wherein said hydrogenation is effected at from 10–40 $kg/cm^2$ of pressure at temperatures of 150°–240° C. using Pd or Ni as a catalyst.

12. The lubricating oil composition of claim 11, wherein said hydrogenation is effectd at from 20–25 $kg/cm^2$ of pressure at a temperature of 170°–180° C. using Pd/C at 10% of Pd as a catalyst.

* * * * *